US006786668B1

(12) United States Patent
Slevin

(10) Patent No.: US 6,786,668 B1
(45) Date of Patent: Sep. 7, 2004

(54) INSTRUMENT FOR HIGHLIGHTING

(76) Inventor: Emil Jon Slevin, 115 India St., Brooklyn, NY (US) 11222-1604

( * ) Notice: Subject to any disclaimer, the term of this patent is extended or adjusted under 35 U.S.C. 154(b) by 0 days.

(21) Appl. No.: 10/370,032

(22) Filed: Feb. 19, 2003

(51) Int. Cl.[7] ..... B43K 5/00; B43K 8/06; B43M 11/06

(52) U.S. Cl. ..... 401/198

(58) Field of Search ..... 401/196, 198, 401/199; D19/35, 43

(56) References Cited

U.S. PATENT DOCUMENTS 3,481,677 A * 12/1969 Abrahamson ..... 401/198
4,933,876 A * 6/1990 Markoff et al. ..... 358/1.4
5,154,193 A * 10/1992 Busch et al. ..... 401/199
5,971,643 A * 10/1999 Ahmed ..... 401/198
6,059,477 A * 5/2000 Dunlap et al. ..... 401/199

FOREIGN PATENT DOCUMENTS

WO WO92/01571 A1 * 2/1992 ..... 401/198

* cited by examiner

*Primary Examiner*—Tuan N. Nguyen
(74) *Attorney, Agent, or Firm*—Thomas A. O'Rourke; Bodner & O'Rourke

(57) ABSTRACT

A highlighting device is disclosed. The device has a body having a reservoir for a quantity of ink and at the first end an applicator tip. The applicator tip has a face for applying ink to a surface. The face is generally rectangular and has a length and a width. The ratio of the length of the face to the width of the face being at least 1:3.

20 Claims, 3 Drawing Sheets

12
18B
24A
24B
19
19A
19B 29
30
33
34
32
27
26

19
20A
20B
10
18
11
18A
20
32
31
29
30
10

INSTRUMENT FOR HIGHLIGHTING

BACKGROUND OF THE INVENTION

At colleges and universities, students are always extracting information from textbooks, outlines, periodicals, etc. that may be useful in their course of study. Many years ago students who were studying material had to underline any textual material that they considered pertinent to their studies. The problem with underlining was that the subject matter of interest really did not stand out from the un-underlined text. Most often, students will highlight a particular portion of text that they feel is important. Traditional highlighting of the text can be accomplished in a number of ways. A student may write a small summary of what they have read next to the portion of the text in which it is located. Alternatively, a symbol, such as an asterisk or star, may denote meaningful content. Also, students may underline portions of the text with a colored pen or pencil. In the above-mentioned ways, a student can highlight portions of the text he or she is reading.

More recently, students have employed highlighting tools. These tools are typically a sealed container with a tip, usually of felt or other porous material. An ink is present in the container and is usually a translucent ink that permits the underlying text to be viewed by the student. In operation the ink is usually wicked from the container through the porous tip. Probably the most commonly known and used alternative to a pen or pencil use, is the use of a bright colored translucent marker. Many markers today use fluorescent ink. The translucent ink marker allows the student to highlight a particular piece of text by writing directly over it. For example, a student can place the marker at one end of the page and trace a line completely to the other side of the page. The marker will deposit, for example, a fluorescent color on the page. The fluorescent color, such as yellow, will be transparent enough so that the student may read the text beneath it. Thus, fluorescent markers typically utilize light colors, such as yellow, light blue, and light pink. Additionally, the fluorescent nature of the marker allows the student to quickly locate the important portions of the text for research or quick reference purposes.

The face of the commonly used marker is most frequently angled for ease of application. The face of the tip is fairly small, typically only high enough to highlight a single line of text, which is sized at standard 12-point font. The width of the face is less than the height. Thus, the student can highlight as little as one word or as much as an entire line of text without lifting the marker off the page. However, if the student desires to highlight an entire paragraph, or an entire page of text, the student must trace over each line of text in a back and forth stroke until the entire page has had ink applied thereto. In the case of long paragraphs, or legal-sized pages, highlighting can become a tedious and time-consuming task.

Additionally, the high lighter's ink deposited on the page by the marker is wet, and does not dry instantaneously. As a result, the repeated back and forth motion of the mark over a large passage can cause the paper to rip or become distorted. Tracing over lines of an entire paragraph will become more time-consuming if the student must wait for each line to dry before going onto the next line. For example, a right-handed student will normally use the fluorescent marker in a left-to-right manner over the line of text. Thus, if a student does not wish to smear the fluorescent ink or get the ink on his or her hand, he or she must wait for the ink to dry. This waiting time can make the highlighting task more time-consuming.

Thus, there is a need, especially for students, to be able to highlight large amounts of text without having to wait for the fluorescent ink to dry. Filling this need will greatly reduce the time required to complete highlighting of a number of texts in which paragraphs and/or pages of text must be highlighted. There is also a need to reduce the risk of tears and distortion due to the motion of the highlighter back and forth over the page

OBJECTS OF THE INVENTION

It is an object of the present invention to provide a highlighting means which is capable of highlighting a single word of text up to an entire page of text in a single motion.

It is an object of the present invention to provide a highlighting means that will drastically reduce the time it takes to highlight by eliminating the waiting time it takes for the translucent ink in a highlighter to dry.

It is an object of the present invention to provide a highlighting means that will allow a user to highlight a large portion of text without lifting the highlighting means off of the paper.

It is an object of the present invention to provide a highlighting means that will allow a user to highlight a large portion of text in a single horizontal or vertical motion.

It is an object of the present invention to provide a highlighter that reduces the need for a large number of back and forth motions to highlight large amounts of text.

It is an object of the present invention to provide a highlighter where the width of the top surface of the tip of the highlighter is significantly greater than the length of the top surface of the tip.

It is another object of the present invention to provide a highlighter where the applicator surface of the tip is generally rectangular and the ratio of the width of the tip to the length of the tip is at least 3:1.

A still further object of the invention is to provide a highlighter where the applicator surface has a width that is as wide as a column of text in a work so that a single line can be highlighted by a single application of the felt tip of the highlighter to a surface of the work.

Another further object of the invention is to provide an applicator tip that is removably attached to the base so that felt tips of varying lengths can be selected for a given application.

SUMMARY OF THE PRESENT INVENTION

The present invention is directed toward an improved highlighting means which will allow the user to highlight a large portion of text in a horizontal or vertical motion, while reducing the need to wait an extended period of time for the highlighter's ink to dry. The present invention is also directed to an improved highlighting means that reduces the need for back and forth motion across the page where large amounts of text must be highlighted.

The highlighting means of the present invention is composed of a body and a cap. The body is generally cylindrical although any shape is possible. The upper portion of the body has a tip over which the cap is placed. The cap is preferably adapted to be removably attached to the lower or end portion of the body, or the base when not in use. The body is a reservoir for the ink that is used. Although any type of suitable ink is possible to use in the instrument, the preferred ink is a translucent ink that permits the viewer to read the text when the ink is applied to a surface having the text thereon. The highlighting means has an applicator tip for applying the ink to the desired surface. The applicator tip of the highlighter is typically a porous material that permits the ink to flow from the reservoir to the applicator surface. The tip extends above the body of the device.

In a first embodiment, the body of the highlighting means is disposed in a vertical manner. The cap has an upper surface and two side surfaces. On the bottom surface of the cap is a receiving means which will allow the top of the highlighter cartridge to fit within it. The base of the highlighting means has a lower surface and two side surfaces. When the cap is connected to the base, the sides of the cap will be continuous with the sides of the base. The base is primarily used to house the highlighter cartridge. In addition, the user will hold the base when using the highlighting means to highlight text. The highlighter cartridge will be shaped to fit fully within the base, while leaving the top portion of the highlighter cartridge exposed. The top portion of the highlighter cartridge should preferably have a diagonal face that will engage the page of the text being highlighted. The diagonal orientation will allow the user to drag the highlighter over the page of text depositing the highlighter ink.

In another embodiment, the body of the highlighting means is horizontally disposed. The main difference between the vertical and horizontal disposition, is that the top portion of the highlighter cartridge will be wider in the horizontal disposition. Thus, a wider top portion will allow the user to highlight more text on a single stroke of the highlighting means across the page.

In each embodiment, the body of the highlighting means may employ a hook or clip which will allow the user to attach the highlighting means to a necklace or belt, respectively.

DETAILED DESCRIPTION OF THE DRAWINGS

Figure 7:
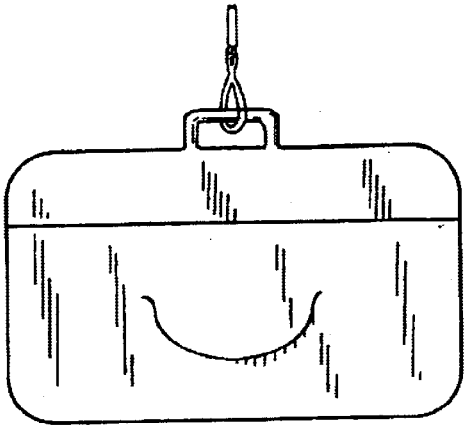
FIG. 7 is an alternative embodiment of a clip on the back of the highlighter of the present invention.
Figure 1:
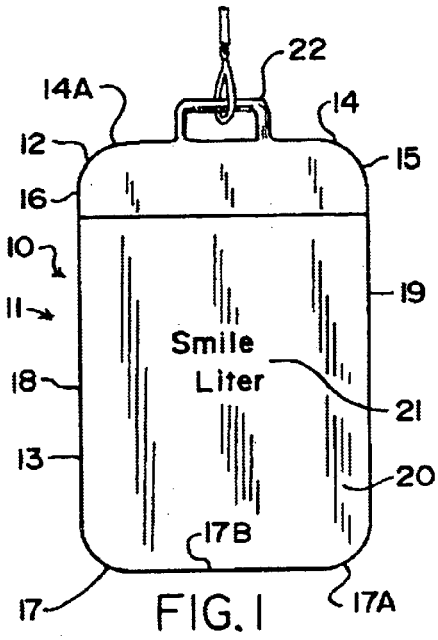
FIG. 1 is a front view of one embodiment of the present invention.

FIG. 1 shows the present invention in what can be characterized as a vertical disposition. The highlighting means 10 is composed, primarily of a body 11 having a front face 20 and a rear face 24. A pair of side surfaces 18 and 19 extends from one face to the other face. The front face 20 and the side surface 18 meet at edge 18A. The rear face 24 and the side surface 18 meet at edge 18B. Similarly, the front face 20 and the side surface 19 meet at edge 19A while the rear face 24 and the side surface 19 meet at edge 19B. The front face and the rear face have a top edge 20A and 24A respectively as well as bottom edges 20B and 24B. The base 13 extends from bottom edges 20B and 24B. Although the body has been shown having a rectangular shape other shapes are possible. A cap 12 may be placed over the top of the device and contact top edges 20A and 24A.

In one embodiment, the cap may have top arc surfaces 14 and 14A and a first side surface 15 and a second side surface 16. The base has a bottom arc surfaces 17 and 17A and a first side surface 19 and a second side surface 18. There may if desired be a generally straight portion 17B between arc 17 and 17A. Portion 17B may also be curved if desired as well. When the highlighting means is in a closed position, as seen in FIG. 1, the cap 12 may engage the base 13 and first side surface 15 may be continuous with side surface 19, as second side surface 16 is continuous with side surface 18.

On the front face 20 of the base 13 is available space for any logo 21. Thus, the highlighting means can be given as a promotional item. Additionally, the highlighting means may have an attachment means such as a hook 22 on the top surface 14B between the arcs 14 and 14A of cap 12. The top surface may be generally straight if desired or curved The hook or ring 22 can be used as an attachment for a necklace if a user wishes to hang the highlighting means around his or her neck. This placement can be for ease of use, convenience and to prevent loss.

Figure 2:
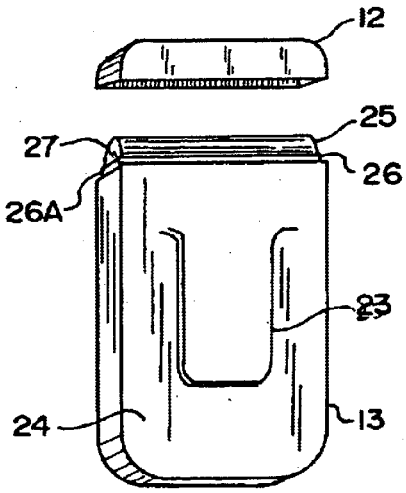
FIG. 2 is a back view of the highlighter of FIG. 1.

Another attachment method can be in the form of a clip 23, as seen in FIG. 2. The clip is preferably on the back face 24 of the base 13. The clip 23 will allow the user to attach the highlighting means to a belt, handbag, or the like. Again, the clip is for ease of use, convenience, and preventing loss.

Also, in FIG. 2, the highlighting means is seen in its open position with the cap 12 disengaged from the base 13. When the cap 12 is disengaged the top portion 25 of the highlighter ink cartridge 26 is exposed. The top portion 25 has a diagonal face 27 that comes in contact with the page when the user wishes to highlight a portion of text. The diagonal face 27 allows the user to highlight the text in a sweeping manner across the page, whether vertically or horizontally. For example, if the face were flat, a user would have to maintain the highlighting means in a perpendicular position to the page in order to apply the highlighting ink in a uniform manner. Thus, the face of the highlighter ink cartridge is preferably diagonal, but may be flat or rounded.

The highlighter ink cartridge 26 also has a reservoir 26A, which is housed in the base 13. The highlighter ink cartridge reservoir 26A is preferably shaped in a similar manner to the base 13 and/or the shape of the ink cartridge or a portion thereof Thus, the highlighter ink cartridge should fit completely within the hollowed-out base, while leaving the diagonal face 27 exposed. However, when the highlighting means is in a closed position the face 27 will fit completely within the hollowed-out cap 12. This design is preferable because it allows for easy use with an exposed face, while allowing for an ample storage space for a highlighter ink cartridge.

A key feature of the present invention is the relationship of the width of the face 27 of the highlighter ink cartridge 26 to its length. By the term width is meant the distance from one edge of the ink cartridge 27A to the other 27B. A wide face will allow a user to highlight large portions of test with a single stroke. The width of the face may be as wide as the length of the cartridge, which would essentially make the highlighting means 10 and body 11 a square, by the term length is meant the distance from 27C to 27C. See FIG. 5. Preferably, however, the width of the face will be at least three times the length of the face and preferably the width is up to 40 times or more the length of the tip face. Preferably, the face should be at least wide enough to highlight at least five lines of single-spaced, 12-point font text within a single horizontal (left-to-right) stroke. In another embodiment, the width of the face may run up to 20 times the length so that a larger area may be covered in a single stroke. It will be appreciated that as the width gets longer there may be disadvantages due to the resultant size of the highlighting body. This can be avoided by not increasing the size of the body as the width of the highlighter cartridge increases. In a preferred embodiment, the length of the face of the highlighter tip is approximately 4 mm to 6 mm. The width of the tip should be at least three times the length or at least 12 mm to 18 mm. In another embodiment, where the length of the tip is 4 mm to 6 mm the width of the tip may be at least 48 to 72 mm. In a still further embodiment, the width of the tip may be at least 96 to 144 mm and the length is about 4 mm to 6 mm. In another embodiment, the width of the tip maybe at least 192 to 288 mm where the length of the tip is about 4 mm to 6 mm. In a still further embodiment, the length of the tip may be about 4 mm to 6 mm and the width of the tip may be about 288 to 432 mm.

The ratio of the length of the face of the tip to the face of the tip may be at least 1:3 to at least 1:72. In one embodiment the ratio of the length of the tip to the width of the tip may be at least 1:48. In another embodiment the ratio of the length of the tip to the width of the tip may be at least 1:24. In a still further embodiment, the length of the tip to the width of the tip may be at least 1:12.

Figures 1A, 2A, 3, 4, 6, 8:
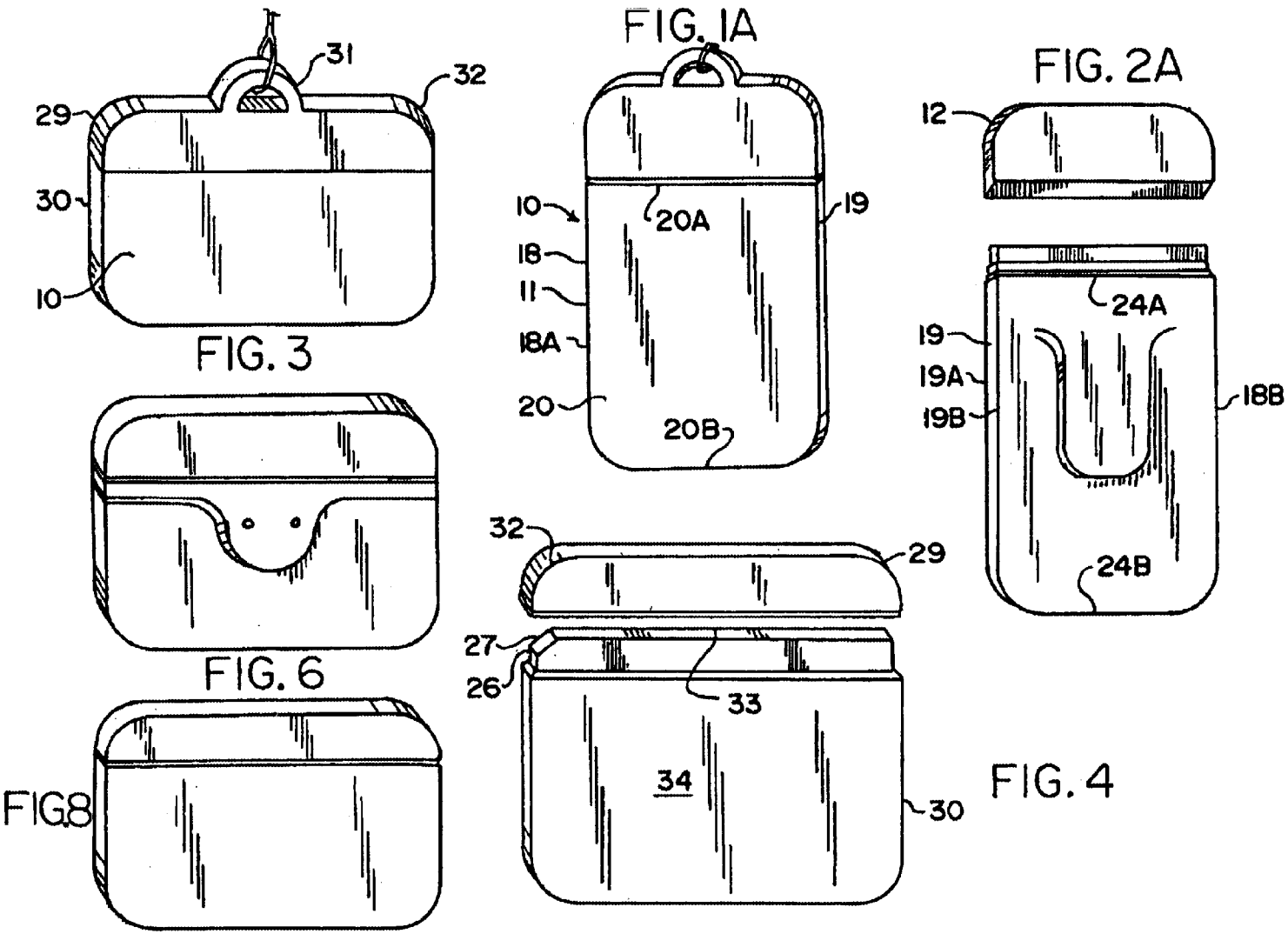
FIG. 1A is a front perspective view of the highlighter of FIG. 1.
FIG. 2A is a back view of a second embodiment of the present invention
FIG. 3 is a front view of an alternate embodiment of the device of FIG. 1.
FIG. 4 is a front view of another embodiment of the device with the cap removed.
FIG. 6 is back view of the embodiment of FIG. 4.
FIG. 8 is front view of the highlighter of FIG. 4 with the cap assembled.

FIG. 3 shows a second embodiment 28 of the present invention. In this embodiment the highlighting means 10 is disposed in a horizontal manner, that is wider than it is high. In this view, the cap 29 is engaged with the base 30. Again, a ring 31 is placed on the top arc portion 32 of the cap 29. Alternatively, instead of a ring there can be a hook. In the embodiment of FIG. 3, the main difference is that a highlighter ink cartridge with a wider face can be used in a horizontal disposition; thus, more text can be highlighted on a single stroke of the highlighting means across the page. FIG. 4 shows the wider face 33 of the highlighting means in a horizontal disposition. Again, the front face 34 of the base 30 has available space for a logo, as in promotional items. Extending the length of the body may compensate for the reduced amount of ink present in the reservoir in this embodiment.

Figure 5:
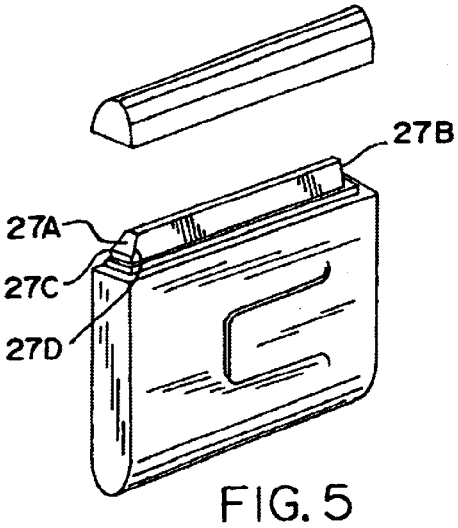
FIG. 5 is back view of an alternate embodiment of FIG. 4 of the present invention.

FIG. 5 shows the positioning of a clip 35 on the back face 36 of the base 30. FIG. 6 shows an alternate embodiment of the horizontally disposed highlighting means 10. In this embodiment, the cap 29 is fused with an attachment piece 37. The attachment piece is used in the same manner as clip 35, as to attach to a belt, handbag, etc. In this embodiment, once the cap is removed, the highlighting means can no longer be attached to a belt, etc. Thus, this embodiment can only be attached to a belt, handbag, etc. when the highlighting means is in a closed position, with the cap 29 engaged with the base 30. Additionally, there is available space for a logo 38.

It is understood that either embodiment may include a hook, clip, or other attachment means. As seen in FIG. 1 the highlighter of the present invention can be provided with a cap having a tab with an orifice therein for receiving a length of flexible material so that the highlighter can be worn around the user's neck. Alternatively, on side of the base can be provided with a clip to permit the highlighter to be clipped to a user's shirt or other surface for ease of use. Additionally, the type of highlighter ink cartridge and face orientation used may vary, as long as a wide face is maintained which will allow the user to highlight large portions of text at one time. In a preferred embodiment, the width of the felt tip of the marker is as wide as a column of text to be highlighted. Thus, the user may apply the highlighting ink to the entire length of a single line in one touch of the paper or other substrate. Similarly, the use of a highlighter having a width that is the same as a length of text in a line has the advantage of permitting the user to highlight a single paragraph in one motion.

In another embodiment the base may have a plurality of removable tip portions each with a felt tip having a different width. The variety of different widths permits the user to change the width of the marker to accommodate material of different widths to be highlighted. Thus a single base with the different width tips can be used in a variety of different books each having a different column width.

The tip portion may be secured to the base by a variety of means. One of the preferred means of connection is a friction fit whereby the base has an end portion that is adapted to be received by a recessed portion in the underside of the tip portion i.e., the part of the tip portion that is opposite the felt tip. In another embodiment the recess may be in the base portion and the tip portion is adapted to be received by the recess in the base portion. In still another embodiment, instead of a friction fit, either the base portion or the tip portion may have a protruding nib that is received by a respective recess in the other member. The protruding nib is received by the recess and retained therein to secure the tip portion to the base portion. In yet still another embodiment, the various size tips can be slid on and off.

Figures 9, 10, 11, 12, 13, 14, 15, 16:
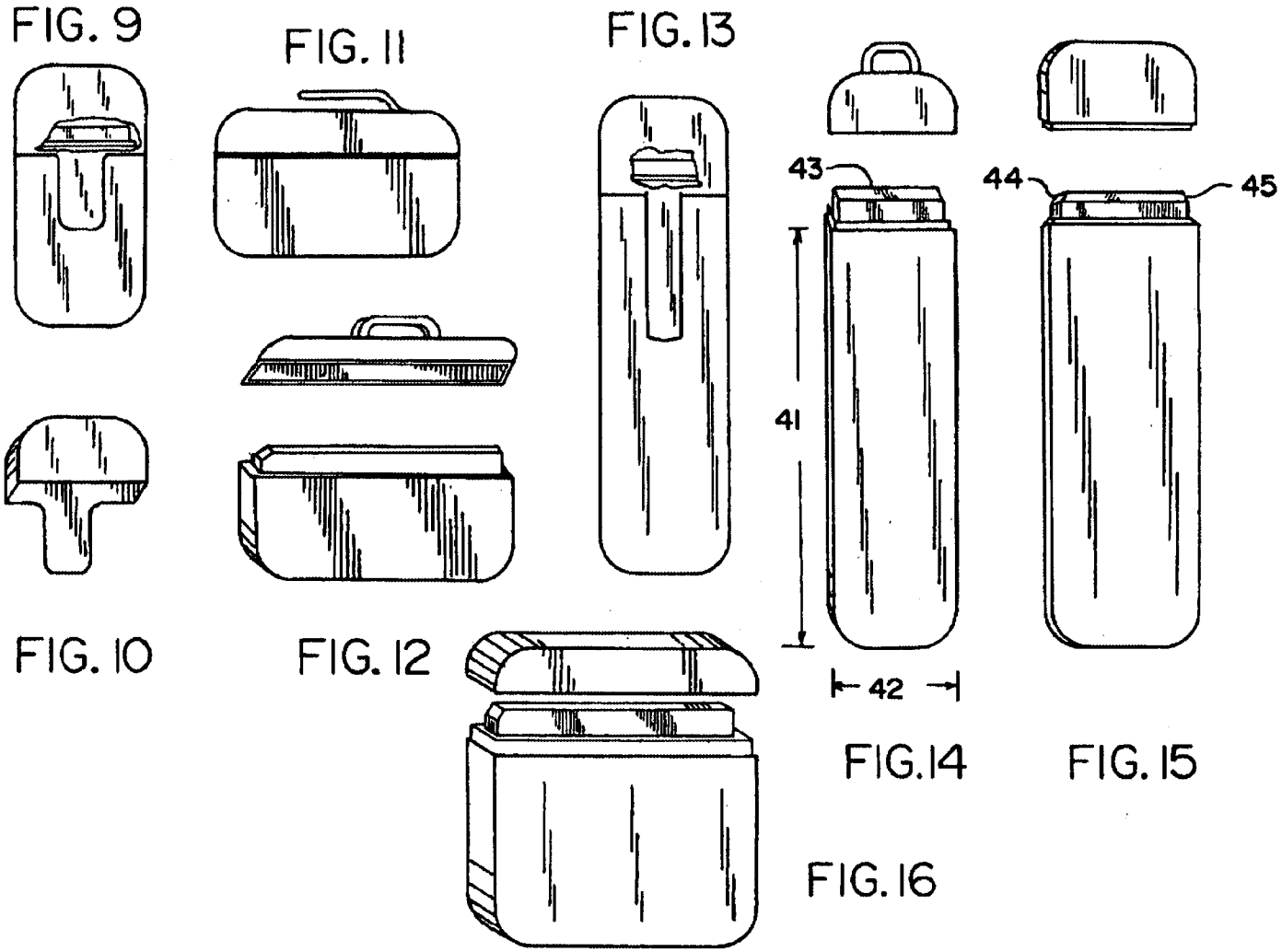
FIG. 9 is a rear view of cut away view of the highlighter similar to FIG. 2A showing the interior of the highlighter when the cap is in place.
FIG. 10 is an alternative embodiment of the clip of the highlighter of the present invention where the clip integral with the cap.
FIG. 11 shows an alternative clip arrangement of the highlighter of the present invention.
FIG. 12 shows another example of a cap and body arrangement for the highlighter of the present invention.
FIG. 13 shows another partially cut out view of an embodiment of the highlighter of the present invention where the ratio of body length to width is at least 2.75:1.
FIG. 14 is an alternative embodiment of the highlighter of FIG. 13 with a flat horizontal and not diagonal applicator surface.
FIG. 15 is an alternative embodiment of the highlighter of FIG. 14 wherein the applicator tip has diagonal end members.
FIG. 16 is an alternative embodiment of FIG. 12 wherein one edge of the applicator surface has a diagonal cut.

FIG. 9 is a rear view of cut away view of the highlighter showing the interior of the highlighter when the cap is in place. FIG. 10 is an alternative embodiment of the clip of the highlighter of the present invention where the clip is integral with the cap. FIG. 11 shows an alternative clip arrangement where the clip is similar to a pen type clip. FIG. 12 shows another example of a cap and body arrangement for the highlighter of the present invention. FIG. 13 shows another partially cut out view of an embodiment of the highlighter of the present invention where the ratio of body length 41 to width 42 is at least 2:1 and more preferable at least 2.5:1 and most preferably at least 3:1.

FIG. 14 is an alternative embodiment of the highlighter of FIG. 13 with a flat horizontal applicator surface 43 and not diagonal applicator surface. FIG. 15 is an alternative embodiment of the highlighter of FIG. 14 wherein the applicator tip has diagonal end members 44 and 45. FIG. 16 is an alternative embodiment of FIG. 12 wherein one edge 46 of the applicator surface has a diagonal cut.

What is claimed:

1. An improved highlighting device comprising a body having a reservoir for a quantity of ink, said body having a front face and a rear face with a pair of side surfaces extending from one face to the other face, said front face and rear face having respective top edges and bottom edges with a base extending from one bottom edge to the other, said base being connected to each of said side surfaces by an arcuate member extending from an end of said base to an end of said side surfaces, said body having an applicator tip extending from a top surface of said body said top surface extending between said top edges, said applicator tip being comprised of a single member, said applicator tip having a first side and a second side each of said sides being generally parallel to each other and a pair of side walls joining said sides, and wherein a first of said sides has a height from said top surface greater than the height from the top surface of the other side, said applicator tip having a single face for applying ink to a surface, said face extending from said first side to said other side, said face being generally rectangular and forming an acute angle with the first of said sides, and having a length extending from one side wall to the other sidewall and a width extending from the first side to the opposite side, the ratio of the length of the face to the width of the face being at least 1:72 and wherein the ratio of said side surfaces to either of said front and rear faces being at least the same ratio.

2. The highlighting device according to claim 1 wherein the ratio of the length of the face to the width of the face is at least 1:12.

3. The highlighting device according to claim 1 wherein the ratio of the length of the face to the width of the face is at least 1:24.

4. The highlighting device according to claim 1 wherein the ratio of the length of the face to the width of the face is at least 1:48.

5. The highlighting device according to claim 1 wherein the ratio of the length of the face to the width of the face is at least 1:3.

6. The apparatus of claim 1 further comprising a cap for covering the applicator tip and wherein said cap has a top arc surface, a first side surface and a second side surface and an open portion opposite said top arc surface for receiving said body.

7. The highlighting apparatus according to claim 1 wherein said side surfaces have a length and the from face has width and the length of said side surface to the width of said front face is at least 3:1.

8. The highlighting apparatus according to claim 1 wherein one of said faces of said body has clip extending therefrom, said clip having a first end and a second end, said clip being secured to said face at said first end, said clip having a first edge and a second edge said edges extending from said face.

9. An improved highlighting device comprising a body having a reservoir for a quantity of ink, said body having a front face and a rear face with a pair of side surfaces extending from one face to the other face, said front face and rear face having respective top edges and bottom edges with a base extending from one bottom edge to the other, said base being connected to each of said side surfaces by an arcuate member extending from an end of said base to an end of said side surfaces, said body having an applicator tip extending from a top surface of said body said top surface extending between said top edges, said applicator tip being comprised of a single member, said applicator tip having a first side and a second side each of said sides being generally parallel to each other and a pair of side walls joining said sides, and wherein a first of said sides has a height from said top surface greater than the height from the top surface of the other side, said applicator tip having a single face for applying ink to a surface, said face extending from said first side to said other side, said face being generally rectangular and forming an acute angle with the first of said sides, and having a length extending from one side wall to the other sidewall and a width extending from the first side to the opposite side, and wherein the length of the face is about 4 to 6 mm long and the width of the face is at least 12 mm long.

10. The highlighting device according to claim 9 wherein the width of the face is at least 48 mm.

11. The highlighting device according to claim 9 wherein the width of the face is at least 96 mm.

12. The highlighting device according to claim 9 wherein the width of the face is at least 192 mm.

13. The highlighting device according to claim 9 wherein the width of the face is at least 288 mm.

14. An apparatus for highlighting more than a single line of text having a typeface of at least 10 points comprising:

comprising a body having a reservoir for a quantity of ink, said body having a front face and a rear face with a pair of side surfaces extending from one face to the other face, said front face and rear face having respective top edges and bottom edges with a base extending from one bottom edge to the other, said base being connected to each of said side surfaces by an arcuate member extending from an end of said base to an end of said side surfaces, said body having an applicator tip extending from a top surface of said body said top surface extending between said top edges, said applicator tip being comprised of a single member, said applicator tip having a first side and a second side each of said sides being generally parallel to each other and a pair of side walls joining said sides, and wherein a first of said sides has a height from said top surface greater than the height from the top surface of the other side, said applicator tip having a single face for applying ink to a surface, said face extending from said first side to said other side, said face being generally rectangular and forming an acute angle with the of said sides, and having a length extending from one side wall to the other sidewall and a width extending from the first side to the opposite side, the ratio of the length of the face to the width the face being at least 1:72 and wherein the ratio of said side surfaces to either of said front and rear faces being at least the same ratio.

15. The highlighting apparatus according to claim 14 wherein the ratio of the length of the face of the applicator tip to the width of the face of the applicator tip is at least 1:12.

16. The highlighting apparatus according to claim 14 wherein the ratio of the length of the face of the applicator tip to the width of the face of the applicator tip is at least 1:24.

17. The highlighting apparatus according to claim 14 wherein the ratio of the length of the face of the applicator tip to the width of the face of the applicator tip is at least 1:48.

18. The highlighting apparatus according to claim 14 wherein the ratio of the length of the face of the applicator tip to the width of the face of the applicator tip is at least 1:3.

19. The apparatus according to claim 14 having a face of the applicator tip with a width sufficient to highlight at least 5 lines of single-spaced, 12-point font text by a single horizontal stroke.

20. The apparatus according to claim 14 having the face of the applicator tip has a width sufficient to highlight at least 10 lines of single-spaced, 12-point font text by a single horizontal stroke.

* * * * *